US011598599B2

(12) United States Patent
Bray

(10) Patent No.: US 11,598,599 B2
(45) Date of Patent: Mar. 7, 2023

(54) FIREARM TRIGGER

(71) Applicant: Polaris Capital Corporation, Orem, UT (US)

(72) Inventor: Ernest R. Bray, American Fork, UT (US)

(73) Assignee: Polaris Capital Corporation, Orem, UT (US)

( * ) Notice: Subject to any disclaimer, the term of this patent is extended or adjusted under 35 U.S.C. 154(b) by 0 days.

(21) Appl. No.: 17/718,265

(22) Filed: Apr. 11, 2022

(65) Prior Publication Data

US 2022/0325971 A1 Oct. 13, 2022

Related U.S. Application Data

(60) Provisional application No. 63/173,164, filed on Apr. 9, 2021.

(51) Int. Cl.
*F41A 19/44* (2006.01)
*F41A 19/45* (2006.01)

(52) U.S. Cl.
CPC ..... *F41A 19/44* (2013.01); *F41A 19/45* (2013.01)

(58) Field of Classification Search
CPC ..... F41A 19/10; F41A 19/44; F41A 19/45
See application file for complete search history.

(56) References Cited

U.S. PATENT DOCUMENTS 2,549,797 A * 4/1951 Gaidos ..... F41A 19/45 89/144
2,804,809 A * 9/1957 Frates ..... F41A 19/15 89/150
4,664,015 A * 5/1987 Kennedy ..... F41A 17/74 89/142
6,382,200 B1 * 5/2002 Levkov ..... F41A 19/12 124/71
9,335,110 B1 * 5/2016 Heizer ..... F41A 19/38
2020/0088486 A1 * 3/2020 Geissele ..... F41A 19/10

FOREIGN PATENT DOCUMENTS

FR 2680234 A1 * 2/1993 ..... F41A 19/10
WO 2015103651 A1 7/2015
WO WO-2015103651 A1 * 7/2015 ..... F41A 17/46

OTHER PUBLICATIONS

Machine Translation of Hosz. <https://patents.google.com/patent/WO2015103651A1/en?oq=WO+2015103651+A1>. (Year: 2015).*
PCT/US2022/024313, "Notification of Transmittal of the International Search Report and the Written Opinion of the International Searching authority, or the Declaration", International Searching Authority, dated Apr. 11, 2022, pp. 1-7.

* cited by examiner

*Primary Examiner* — Gabriel J. Klein
(74) *Attorney, Agent, or Firm* — Kunzler Bean & Adamson

(57) ABSTRACT

Disclosed is a linear trigger mechanism for a firearm. In certain examples, the trigger mechanism includes a trigger housing defining a linear pathway and configured to house a trigger, a sear, and a disconnector. The trigger has a top surface, and a sear ramp and a disconnector ramp disposed on the top surface. The trigger is configured to move along the linear pathway that is substantially parallel with a bore axis of the firearm. The trigger mechanism also includes a trigger return compression spring configured to urge the trigger into a default position, and a sear compression spring configured to urge the sear into a default position.

20 Claims, 8 Drawing Sheets

FIREARM TRIGGER

FIELD

This application claims the benefit of U.S. Provisional Patent Application No. 63/173,164 entitled "FIREARM TRIGGER" and filed on Apr. 9, 2021 for Ernest R. Bray, which is incorporated herein by reference.

FIELD

This disclosure relates generally to firearms, and more particularly to linear trigger mechanisms for firearms.

BACKGROUND

Firearms typically have a trigger mechanism that is used to discharge the firearm. Commonly, trigger mechanisms have a hammer, that is spring-loaded, that strikes a firing pin that in turn strikes an ammunition cartridge positioned in a chamber of the firearm. Pulling a trigger of the trigger mechanism initiates this sequence. A rough or uneven trigger pull can affect the accuracy of the firearm.

SUMMARY

Disclosed is a linear trigger mechanism for a firearm. In certain examples, the trigger mechanism includes a trigger housing defining a linear pathway and configured to house a trigger, a sear, and a disconnector. The trigger has a top surface, and a sear ramp and a disconnector ramp disposed on the top surface. The trigger is configured to move along the linear pathway that is substantially parallel with a bore axis of the firearm. The trigger mechanism also includes a trigger return compression spring configured to urge the trigger into a default position, and a sear compression spring configured to urge the sear into a default position.

The trigger mechanism, in certain examples, includes a pair of opposing slide rails, where each of the pair of opposing slide rails is defined by a recess in an interior lateral side of the trigger housing and is disposed substantially parallel with the bore axis. The trigger is configured to slide in the pair of opposing slide rails between a first default position and a second position. The trigger return compression spring, in certain examples, is disposed between the trigger housing and the trigger.

In certain examples, the disconnector and the sear are pivotable about a common pin. The sear has a first end that extends in a first direction from the common pin and a second end that extends in a second direction from the common pin. In certain examples, the sear compression spring is disposed between the first end and a hammer. The second end of the sear comprises a sear hook member configured to engage the hammer until a force sufficient enough to overcome the sear compression spring is applied to the sear by the sear ramp.

The sear ramp, in certain examples, is disposed on a planar top surface of the trigger. The disconnector is formed of a first end extending in the first direction from the common pin and a second end extending in the second direction from the common pin. The first end of the disconnector comprises a hook member configured to engage a surface of the hammer.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one example," "an example," or similar language means that a particular feature, structure, or characteristic described in connection with the example is included in at least one example of the present disclosure. Appearances of the phrases "in one example," "in an example," and similar language throughout this specification may, but do not necessarily, all refer to the same example. Similarly, the use of the term "implementation" means an implementation having a particular feature, structure, or characteristic described in connection with one or more examples of the present disclosure, however, absent an express correlation to indicate otherwise, an implementation may be associated with one or more examples.

Figure 1:
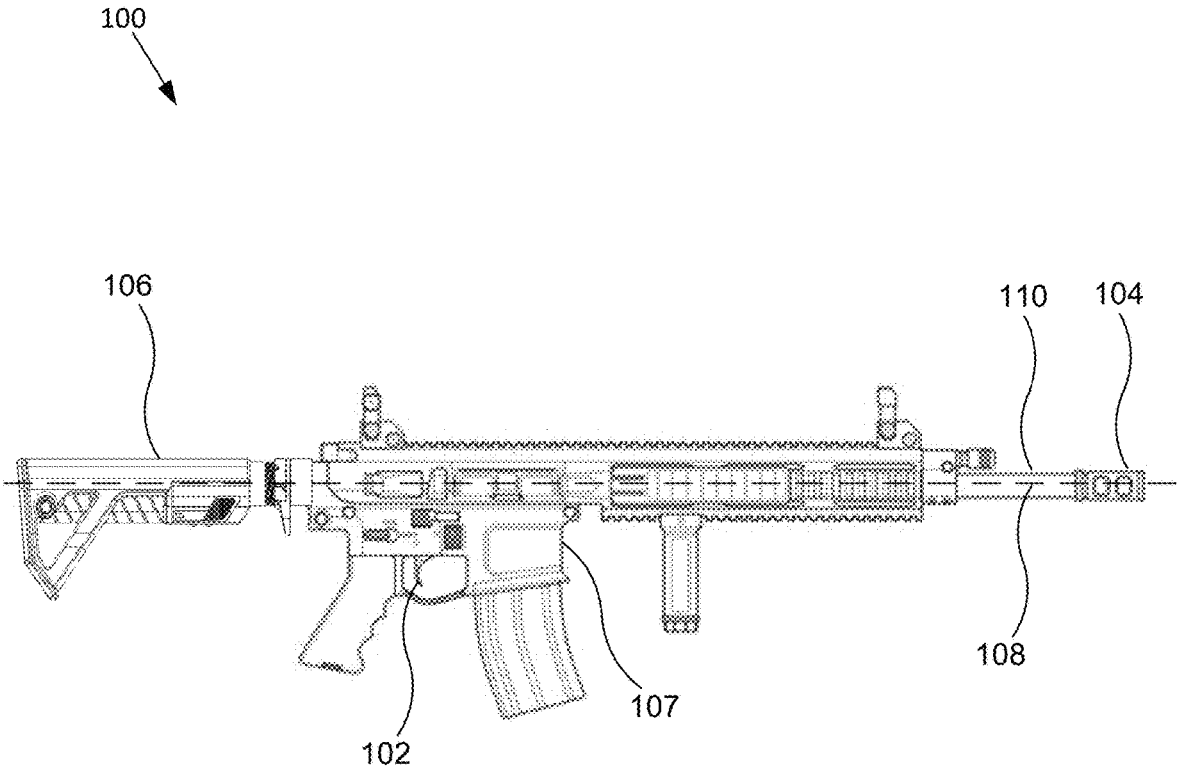
FIG. 1 is a side view diagram illustrating one embodiment of a firearm including an improved trigger mechanism in accordance with embodiments of the present disclosure.

FIG. 1 is a side view diagram illustrating one embodiment of a firearm 100 including an improved trigger mechanism 102 in accordance with embodiments of the present disclosure. The trigger mechanism, in the depicted embodiment, may be used with the M16 family of firearms including, but not limited to, all AR variants, the M16 firearm, the M4 firearm, and others with use a bolt carrier. As used herein, the terms "forward" and "front" refer to ends of mechanisms that are nearest the muzzle end 104 of the firearm 100. Similarly, "rear," "rearward," correspond to ends of mechanisms that are furthest from the muzzle end 104 of the firearm (i.e., towards the stock 106). However, it is contemplated that the features of the current disclosure are equally applicable to other types of firearms.

As will be discussed in greater detail below, the present disclosure provides a linearly moving trigger slide mounted within a trigger mechanism using compression springs that provide predictability and repeatability of trigger pulls. The trigger slide beneficially moves linearly in relation to a lower receiver 107 of the firearm 100. In certain examples, the trigger slide moves along an axis that is substantially parallel with a bore axis 108 that is defined by a barrel 110 of the firearm 100.

Figure 2:
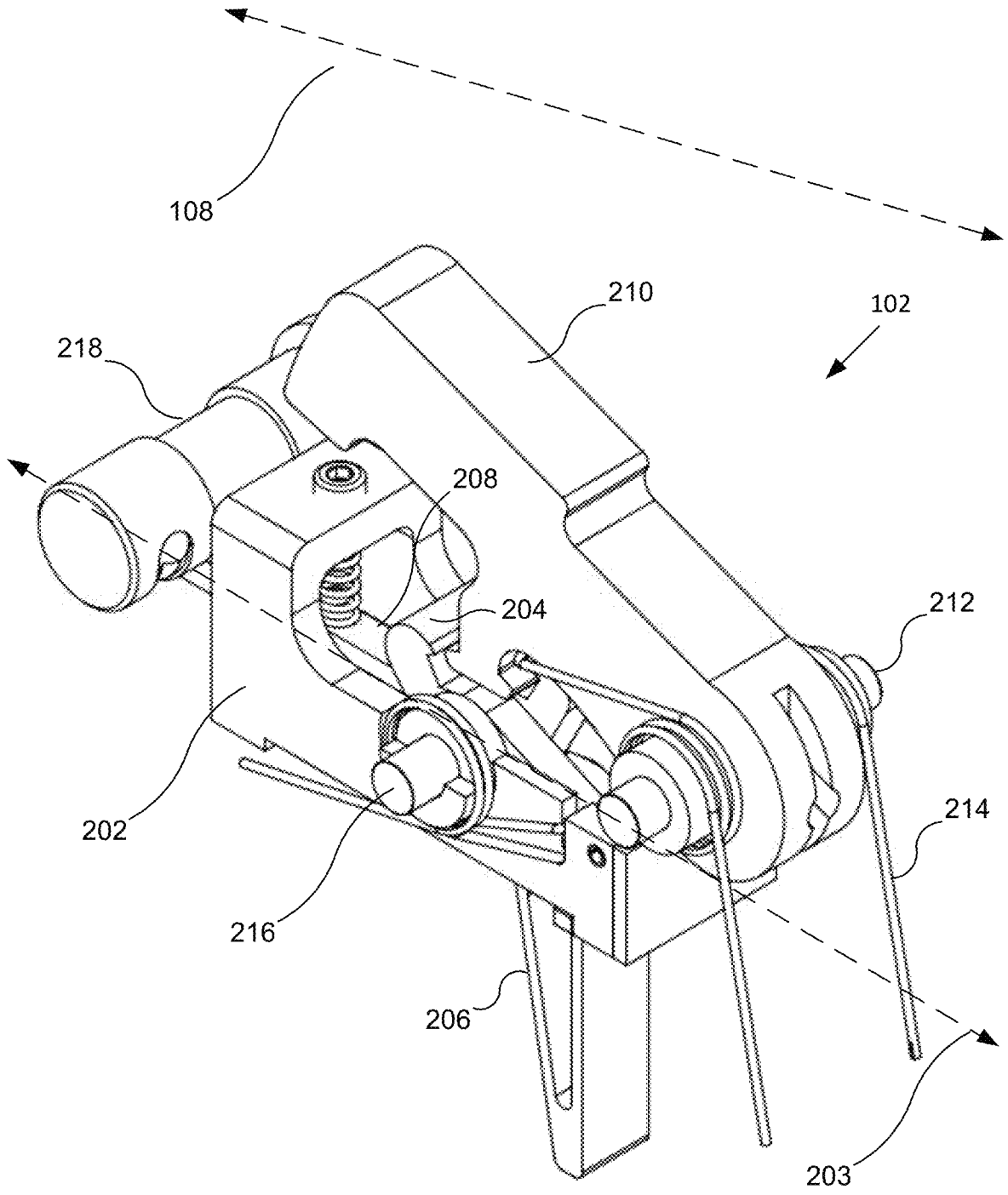
FIGS. 2 and 3 are perspective view diagrams of the trigger mechanism, according to examples of the subject disclosure.
Figure 3:
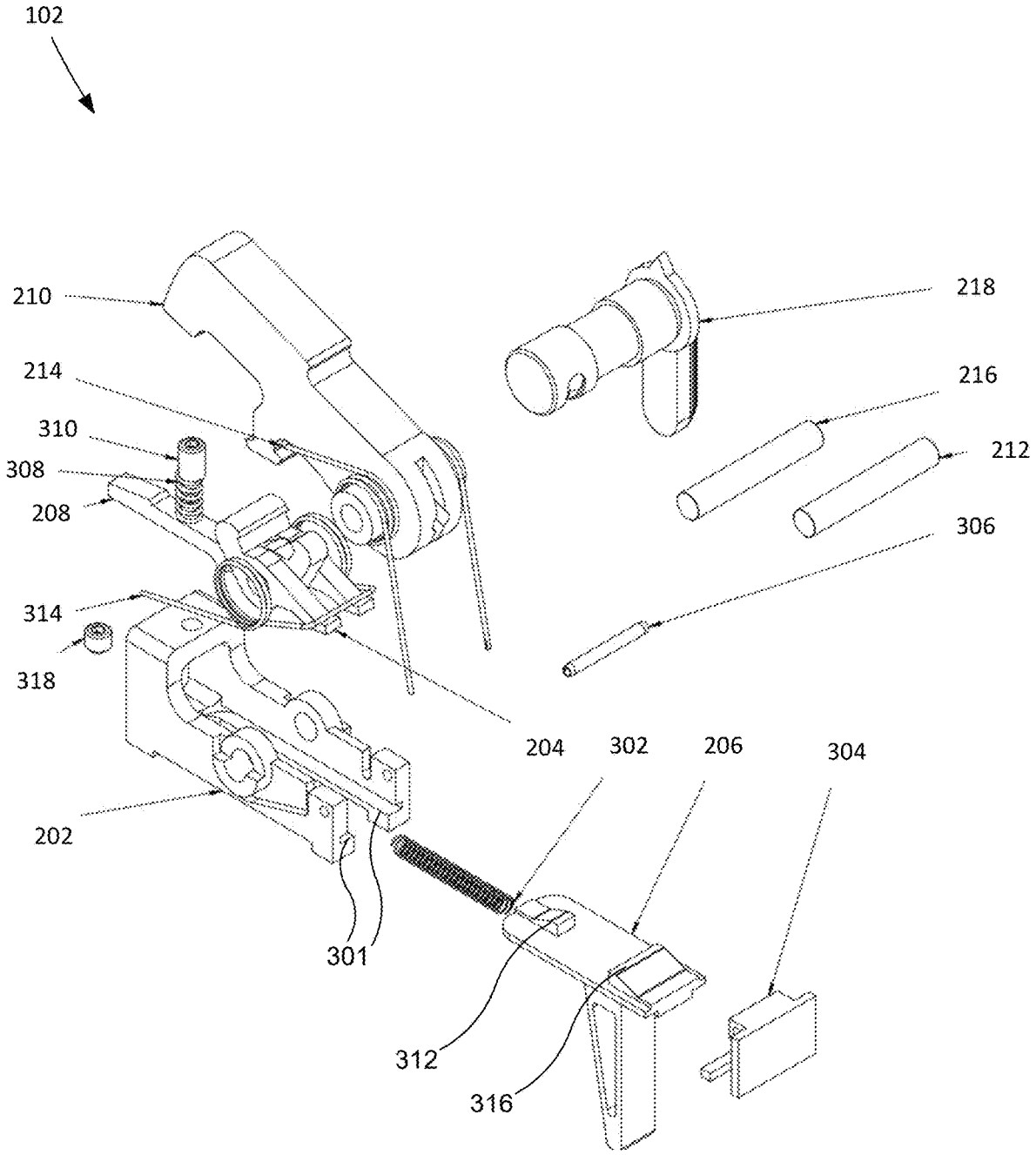

FIGS. 2 and 3 are perspective view diagrams of the trigger mechanism 102, according to examples of the subject disclosure. FIG. 3 illustrates an exploded view diagram of the trigger mechanism 102 depicted in FIG. 2. The trigger mechanism 102, in certain examples, includes a housing 202 that supports the various components of the trigger mechanism 102. The housing 202, as depicted, may include various openings and cut-outs for facilitating the placement and operation of components including, but not limited to, a disconnector 204, a trigger 206, and a sear 208. A hammer 210, which is pivotally coupled with the lower receiver of the firearm 100 via a hammer pin 212, moves between a cocked and ready to fire position, and a fired position which causes a round to discharge. The hammer 210 has a striking surface configured to strike a firing pin (not shown) of the firearm 100. The firing pin transfers a force from the hammer 210 to the round (i.e., cartridge) and causes the round to fire and eject a projectile from a casing of the cartridge that travels through the barrel 110 and exits with a high rate of speed.

The hammer 210, in certain examples, is biased towards the fire position by a torsion hammer spring 214 disposed around the hammer pin 212. The legs of the torsion hammer spring 214 depicted in FIG. 2 are biased against a surface feature (not shown) of an interior surface of the lower receiver 107. The trigger mechanism 102, via various mechanisms that will be described in greater detail, catches the hammer 210 in a ready-to-fire position until the trigger 206 releases the hammer 210. In certain examples, the disconnector 204 holds the hammer 210 in the ready-to-fire position. The disconnector 204, in certain examples, is pivotally coupled with the housing 202 via a trigger housing pin 216. The trigger housing pin 216 also functions to secure the trigger mechanism 102 with the lower receiver 107. The sear 208 is also pivotally coupled with the housing 202 via the trigger housing pin 216. A safety selector 218 is movable between a safety position that prevents the trigger 206 from releasing the hammer 210, and a ready-to-fire position that allows the hammer 210 to be released. Within the housing, the trigger 206 moves linearly along a pathway 203 that is substantially parallel with the bore axis 108 of the barrel. Conversely, common trigger mechanisms have triggers that pivot about a pivot point and therefore one end of the triggers moves along an arcuate pathway.

Turning now to FIG. 3, depicted here is an exploded view diagram illustrating the trigger mechanism 102, according to examples of the subject disclosure. In certain examples, the trigger housing 202 includes a pair of opposing slide rails 301 disposed on interior surfaces of the trigger housing 202. The slide rails 301 provide a pathway for guiding the movement of the trigger 206. The slide rails 301 define a linear path through which the trigger 206 moves between a first default position and a second position. A trigger return spring 302, which is a compression spring, biases the trigger 206 towards the first position. The compression spring, beneficially, allows for a consistent trigger pull experience throughout the entire pathway that the trigger 206 moves. Unlike other conventional trigger mechanisms with pivotally mounted triggers that use torsion springs, the force required to overcome the trigger return spring 302 is consistent despite an operator's finger position with respect to the trigger 206. In other words, when using a conventional trigger mechanism, if the operator positions his or her trigger finger at the tip of the trigger, the force required to overcome the torsion spring is different than if the trigger finger is positioned closer to the lower receiver, for example. Further, compression springs, such as the trigger return spring 302 provide a more consistent biasing force to the trigger 206 than a torsion spring.

In certain examples, the trigger mechanism 102 also includes a trigger housing end plate 304 that is couplable to the trigger housing 202 by a trigger housing end plate pin 306. Other fastening mechanisms for securing the trigger housing end plate 304 to the trigger housing 202 are contemplated, and may be utilized in place of the trigger housing end plate pin 306.

Also depicted, in the example of FIG. 3, is a sear spring 308 and a sear spring adjuster 310. The sear spring 308, like the trigger return spring 302, may be a compression spring that beneficially provides a consistent, repeatable, trigger pull experience. The sear spring 308 is positioned near an end of the sear 208 and must be overcome before the hammer 210 is released. A sear ramp 312 positioned on top of the trigger 206 engages the sear 208 as the trigger 206 moves from the first position to the second position. The biasing force of the sear spring 308 may be adjusted by the sear spring adjuster 310 to allow the operator to customize the trigger pull weight of the trigger mechanism 102. In a sense, the trigger mechanism 102 has a first stage trigger pull weight (e.g., overcoming the trigger return spring 302) and a second stage trigger pull weight (e.g., overcoming the sear spring 308).

The sear ramp 312, in certain examples, is disposed along a longitudinal center line of the trigger 206 with dimensions that allow the sear ramp 312 to pass between fingers of the disconnector 204 as the trigger 206 travels between the first position and the second position. This, beneficially, allows the sear ramp 312 to activate the sear 208 without interfering with the disconnector 204. The sear 208 includes a hook member that releasably latches onto the hammer 210. By adjusting a ramp angle, ramp length, and position of the sear ramp 312, the operator may adjust the timing of the trigger 206 operation. In other words, the operator may be provided with a different sear ramp 312 that alters the linear position of the trigger 206 at which the sear 208 releases the hammer 210 and causes the firearm to fire.

The safety selector 218, in certain examples, is substantially cylindrical and formed with a flat side for (see FIG. 5) that allows for vertical movement of the sear 208. If the flat side is facing downward, the sear 208 is allowed to travel upward when engaged by the sear ramp 312 and release the hammer 210. Otherwise, the safety selector 218 prevents the upward movement of the sear 208 and prevents the hammer 210 from firing a round.

The disconnector 204, in certain examples, is biased by a disconnector torsion spring 314 which is disposed around the trigger housing pin 216. The disconnector torsion spring 314 is configured to bias the disconnector 204 towards a first position which causes a hook member of the disconnector 204 to couple to a latch member of the hammer 210. The disconnector 204 is activated by a disconnector ramp 316 that is disposed on top of the trigger 206. The disconnector ramp 316, in certain examples, is positioned on a platform of the trigger 206 opposite the sear ramp 312, and dimensioned with a width selected to correspond with the fingers of the disconnector 204 (arrow 204 identifies one of the fingers of the disconnector).

Also depicted is a trigger return spring adjuster 318. The trigger return spring adjuster is configured to increase or decrease a biasing force of the trigger return spring 302, and thereby increase or decrease the first stage trigger pull weight of the trigger 206.

Figure 4:
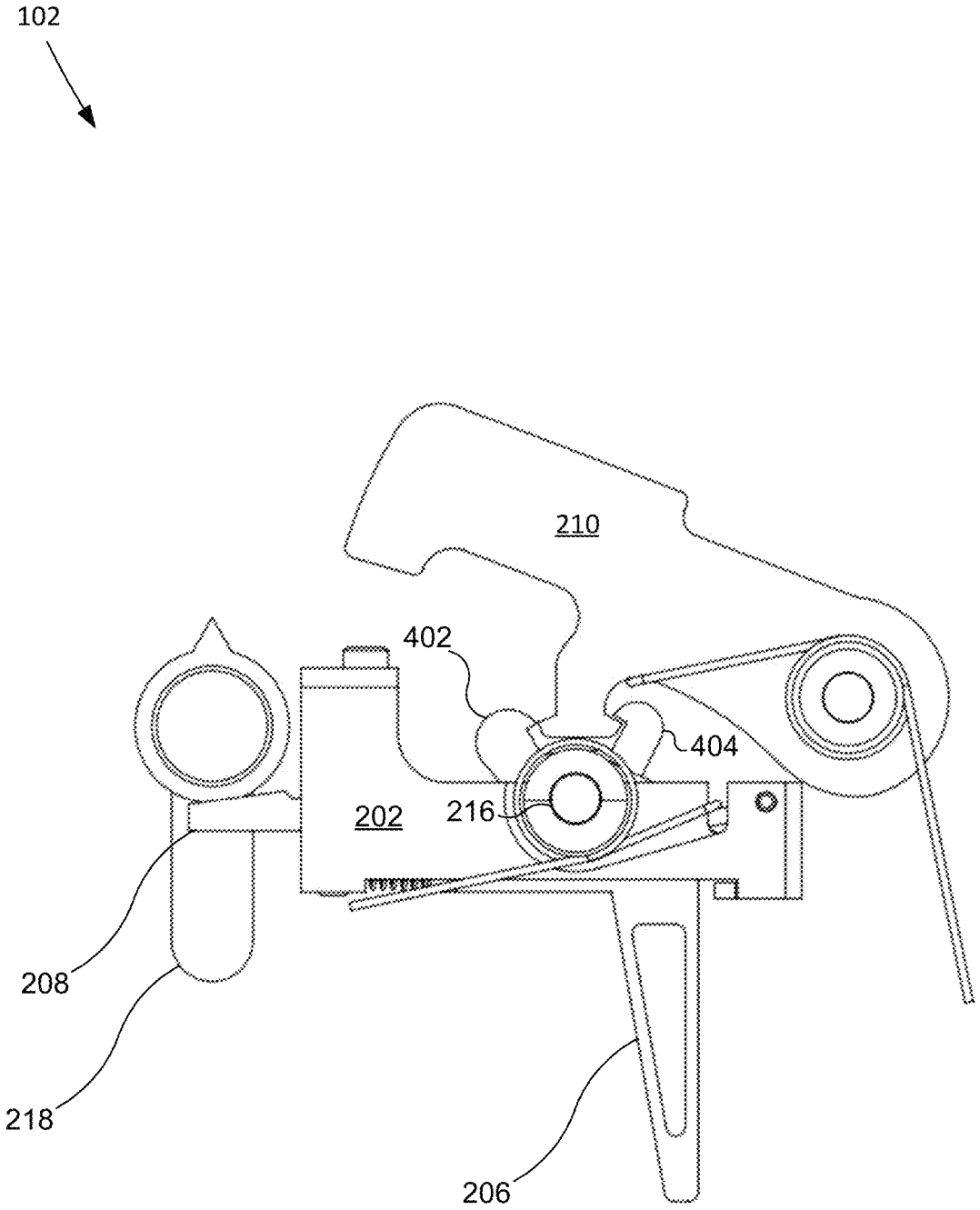
FIG. 4 is a side view diagram illustrating the trigger mechanism, according to examples of the subject disclosure.

FIG. 4 is a side view diagram illustrating the trigger mechanism 102, according to examples of the subject disclosure. The depicted embodiment illustrates the trigger mechanism in a safety off, ready to fire position. The hammer 210 is caught by the hook member 402 of the disconnector 204 and the hook member 404 of the sear 208. The safety selector 218 is positioned to allow the end of the sear 208 to travel upward and pivot around the trigger housing pin 216 to release the hammer 210 when activated by the sear ramp of the trigger 206.

Another beneficial feature of the trigger mechanism 102 of the subject disclosures is the arrangement of the sear 208 with respect to the firearm 100. In some cases, dropping a firearm unintentionally on its buttstock may cause a conventional trigger mechanism to release the hammer and discharge a round. However, in examples of the subject disclosure, a rearward impact of the buttstock would cause the hook member 404 of the sear 208 to increase engagement with the hammer 210 due to the direction of the momentum of the falling firearm. This beneficially prevents unintentional firing of the firearm.

Figure 5:
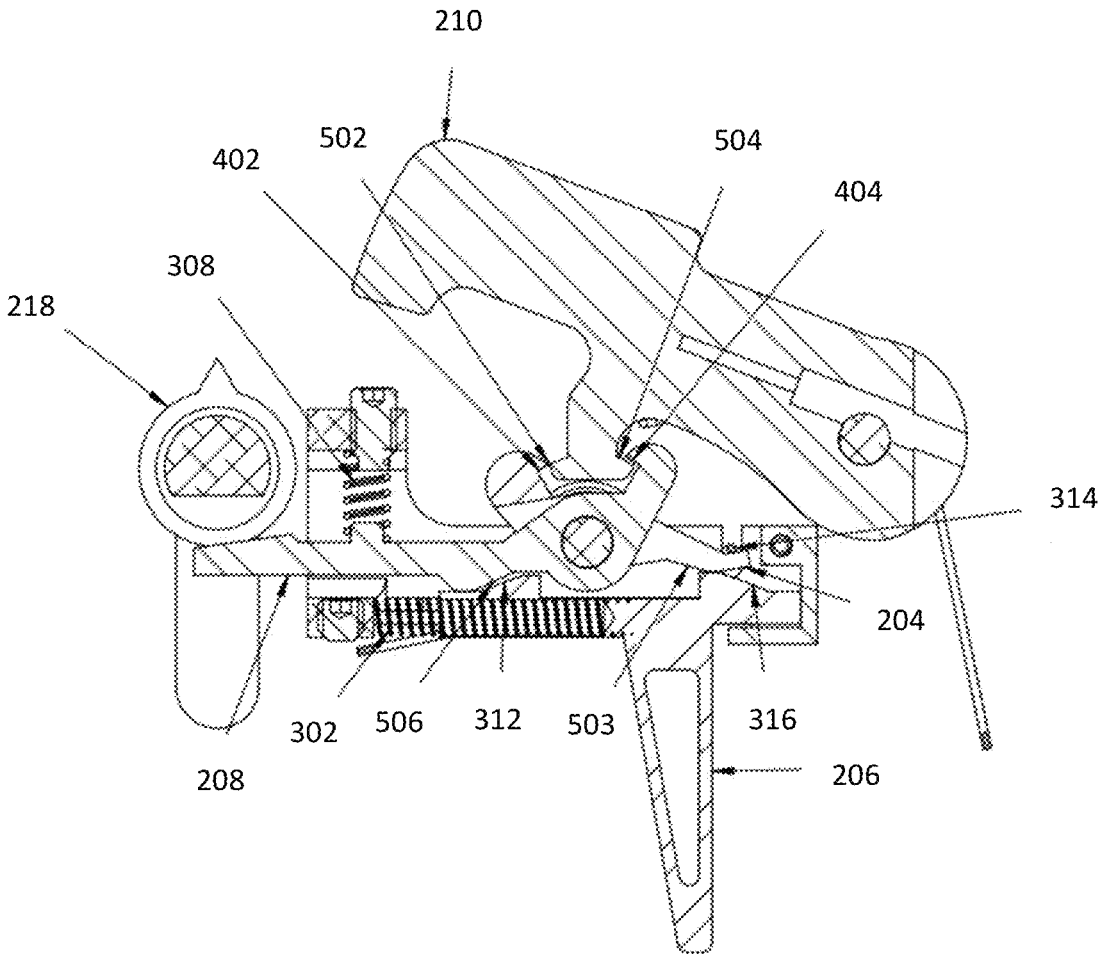
FIG. 5 is a cross-sectional diagram illustrating a side view of the trigger mechanism according to examples of the subject disclosure.

FIG. 5 is a cross-sectional diagram illustrating a side view of the trigger mechanism 102 according to examples of the subject disclosure. In particular, FIG. 5 depicts the safety off, ready to fire position described above with reference to FIG. 4. In the depicted example, the trigger 206 is in the default position, having been returned to this position by the trigger return spring 302. The disconnector ramp 316 is engaging the fingers 503 of the disconnector 204 and pivoting the disconnector 204 about the trigger housing pin, after overcoming the disconnector torsion spring 314, which causes the hook member 402 of the disconnector to disengage from a shelf surface 502 of the hammer 210.

Although the disconnector 204 has been released in this configuration, the hook member 404 of the sear 208 is connected with a shelf surface 504 of the hammer 210. In this trigger position, the sear 208 has not yet been activated by the sear ramp 312. A corresponding ramp 506 formed on a bottom surface of the sear 208 engages the sear ramp 312 of the trigger 206 and causes the sear 208 to pivot around the trigger housing pin 216. Once the sear spring 308 is overcome, the hook member 404 of the sear 208 will release the hammer 210. The disconnector 204 is configured to capture, after a trigger pull, the hammer after it has fired a round and a bolt carrier group (not shown) has returned the hammer back to the depicted position, and before the trigger is released by the operator. In other words, the movement of the hammer 210 is so rapid that a mechanism is needed to capture the hammer 210 during the moment between when the trigger is pulled, and the trigger is released. This situation is depicted and described in greater detail below with reference to FIG. 6.

Figure 6:
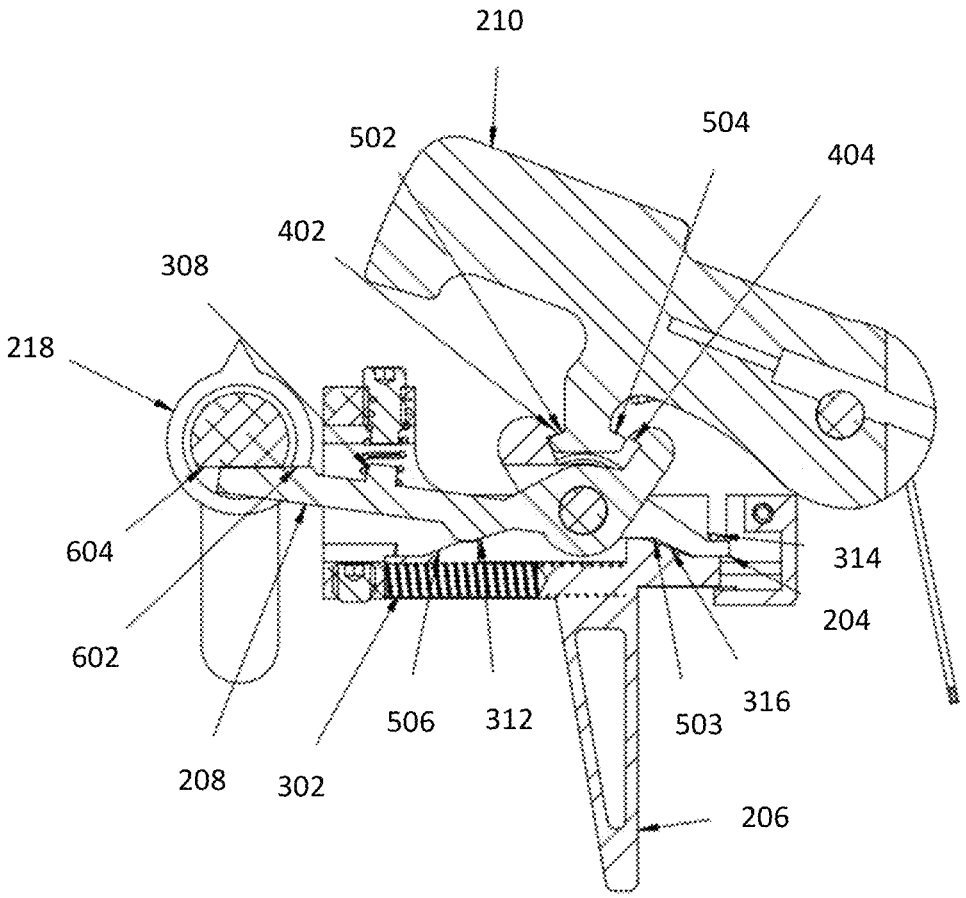
FIG. 6 is a cross-sectional view diagram illustrating a side view of the trigger mechanism, according to examples of the subject disclosure.

FIG. 6 is a cross-sectional view diagram illustrating a side view of the trigger mechanism 102, according to examples of the subject disclosure. In the depicted example, the trigger 206 is in a "held" position after the trigger has been pulled and the hammer has fired a round. Moments after firing the round, but before the trigger 206 has been released by the operator, the hammer 210 is returned to a ready to fire position, but the sear ramp 312 is still engaging the sear 208 which prevents the hook member 404 of the sear 208 from catching the hammer 210. The disconnector 204 catches the hammer 210, however, and prevents the hammer 210 from firing another round. Also depicted is a surface 602 of the sear 208 that engages the flat 604 of the safety selector 218.

Figure 7:
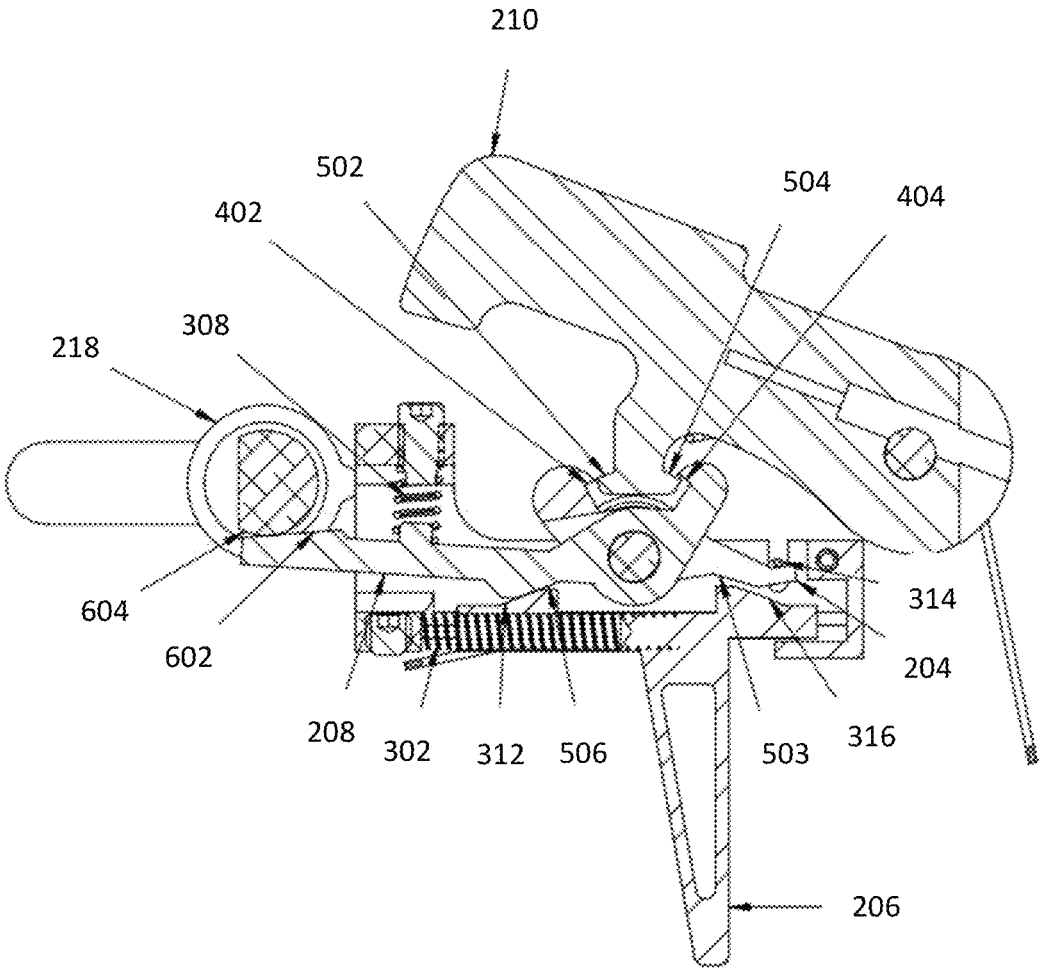
FIG. 7 is a cross-sectional view diagram illustrating a side view of the trigger mechanism, according to examples of the subject disclosure.

FIG. 7 is a cross-sectional view diagram illustrating a side view of the trigger mechanism 102, according to examples of the subject disclosure. In the depicted example, the safety selector 218 is in a "safety on" position that prevents firing of the firearm 100. In the depicted embodiment, the flat 604 of the safety selector 218 is rotated away from the sear 208, thereby preventing vertical movement of the sear 208 necessary to release the hammer 210. Because the end of the sear 208 is prevented from lifting or moving upward when engaged by the sear ramp 312 of the trigger 206 by the safety selector 218, the sear 208 is not able to rotate about the trigger housing pin 216 and the hook member 404 will not release the hammer 210.

Figure 8:
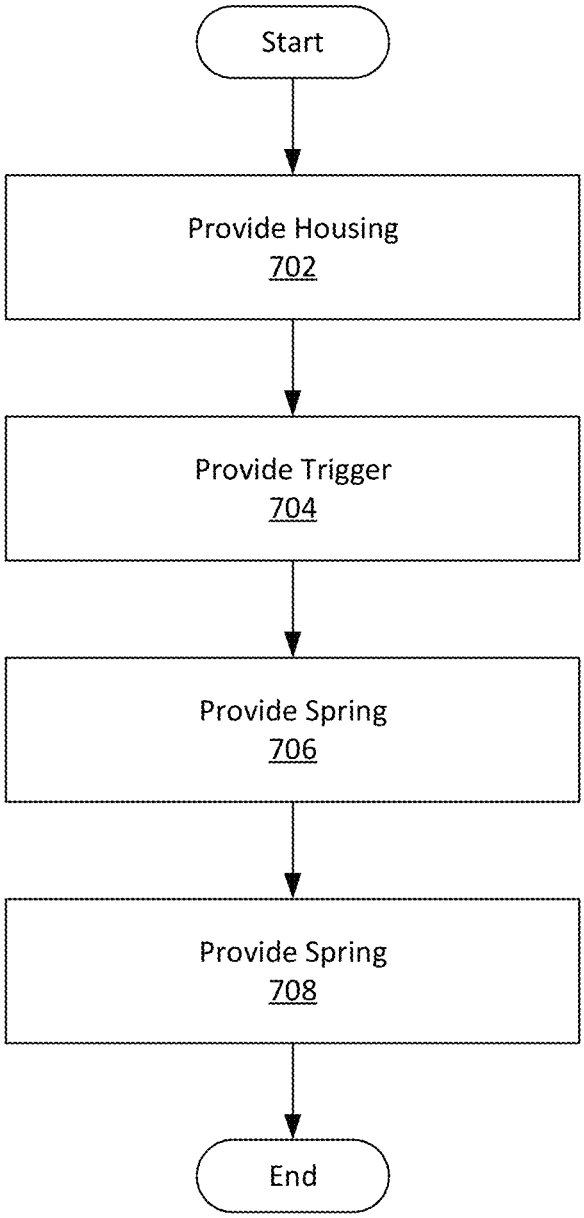
FIG. 8 is a schematic flowchart diagram illustrating an example of providing an improved trigger mechanism, according to examples of the subject disclosure.

FIG. 8 is a schematic flowchart diagram illustrating an example of providing an improved trigger mechanism, according to examples of the subject disclosure. The method, in certain examples, includes providing a housing 702. In certain examples, the housing provides a linear pathway through which a trigger moves from a first default position to a second position. The housing also provides various openings and cutouts for mounting a sear and a disconnector. The method also includes providing a trigger 704 with a top surface having a sear ramp and a disconnector ramp. In certain examples, the method also includes providing 706 a compression spring for biasing the trigger, and providing 708 a compression spring for biasing the sear. In other examples, the method includes providing other necessary and optional components to improve the functionality of the trigger mechanism 102.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The schematic flow chart diagrams included herein are generally set forth as logical flow chart diagrams. As such, the depicted order and labeled steps are indicative of one example of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The present subject matter may be embodied in other specific forms without departing from its spirit or essential characteristics. The described examples are to be considered in all respects only as illustrative and not restrictive. All changes which come within the meaning and range of equivalency of the claims are to be embraced within their scope.

What is claimed is:

1. A trigger mechanism for a firearm, comprising:

a monolithic trigger including a sear ramp and a disconnector ramp on a top surface thereof;

a trigger housing defining a linear pathway and configured to house the trigger, a sear, and a disconnector;

where the trigger is configured to move along the linear pathway, which is substantially parallel with a bore axis of the firearm;

a trigger return compression spring configured to urge the trigger into a default position; and a sear compression spring configured to urge the sear into a default position.

2. The trigger mechanism of claim 1, where the trigger housing further comprises a pair of opposing slide rails, where each of the pair of opposing slide rails is defined by a recess in an interior lateral side of the trigger housing and is disposed substantially parallel with the bore axis.

3. The trigger mechanism of claim 2, where the trigger is configured to slide in the pair of opposing slide rails between a first default position and a second position.

4. The trigger mechanism of claim 3, where the trigger return compression spring is disposed between the trigger housing and the trigger.

5. The trigger mechanism of claim 1, where the disconnector and the sear are pivotable about a common pin.

6. The trigger mechanism of claim 5, where the sear comprises a first end extending in a first direction from the common pin and a second end extending in a second direction from the common pin.

7. The trigger mechanism of claim 6, where the sear compression spring is disposed between the first end and a hammer.

8. The trigger mechanism of claim 7, where the second end of the sear comprises a sear hook member configured to engage the hammer until a force sufficient enough to overcome the sear compression spring is applied to the sear by the sear ramp.

9. The trigger mechanism of claim 8, where the sear ramp is disposed on a planar top surface of the trigger.

10. The trigger mechanism of claim 7, where the disconnector comprises a first end extending in the first direction from the common pin and a second end extending in the second direction from the common pin.

11. The trigger mechanism of claim 10, where the first end of the disconnector comprises a hook member configured to engage a surface of the hammer.

12. A firearm having a linearly moveable trigger with respect to the firearm, the firearm comprising:

a trigger housing defining a linear pathway and configured to house the trigger, a sear, and a disconnector;

the trigger being monolithic and including a sear ramp and a disconnector ramp on a top surface thereof, and where the trigger is configured to move along the linear pathway, which is substantially parallel with a bore axis of the firearm;

a trigger return compression spring configured to urge the trigger into a default position; and a sear compression spring configured to urge the sear into a default position.

13. The firearm of claim 12, where the trigger housing further comprises a pair of opposing slide rails, where each of the pair of opposing slide rails is defined by a recess in an interior lateral side of the trigger housing and is disposed substantially parallel with the bore axis.

14. The firearm of claim 13, where the trigger is configured to slide in the pair of opposing slide rails between a first default position and a second position.

15. The firearm of claim 14, where the trigger return compression spring is disposed between the trigger housing and the trigger.

16. The firearm of claim 12, where the disconnector and the sear are pivotable about a common pin.

17. The firearm of claim 16, where the sear comprises a first end extending in a first direction from the common pin and a second end extending in a second direction from the common pin.

18. The firearm of claim 17, where the sear compression spring is disposed between the first end and a hammer.

19. The firearm of claim 18, where the second end of the sear comprises a sear hook member configured to engage the hammer until a force sufficient enough to overcome the sear compression spring is applied to the sear by the sear ramp.

20. The firearm of claim 19, where the sear ramp is disposed on a planar top surface of the trigger.

* * * * *